United States Patent [19]

Takashima et al.

[11] Patent Number: 4,855,783

[45] Date of Patent: Aug. 8, 1989

[54] AGITATING ROLLER AND RESTRICTING MEMBER FOR A DEVELOPING DEVICE

[75] Inventors: Masayuki Takashima, Yokohama; Noboru Sawayama, Tokyo, both of Japan

[73] Assignee: Ricoh Company, Ltd., Tokyo, Japan

[21] Appl. No.: 122,685

[22] Filed: Nov. 18, 1987

[30] Foreign Application Priority Data

Nov. 18, 1986 [JP] Japan ..... 61-176098

[51] Int. Cl.[4] ..... G03G 15/00

[52] U.S. Cl. ..... 355/298; 355/3 DD; 355/260; 355/245; 118/658

[58] Field of Search ..... 355/3 DD, 14 D; 118/657, 658, 612, 656

[56] References Cited

U.S. PATENT DOCUMENTS

| | | | |
|---|---|---|---|
| 4,559,898 | 12/1985 | Fukuchi et al. | 118/658 |
| 4,583,843 | 4/1986 | Ohata et al. | 355/3 DD |
| 4,601,259 | 7/1986 | Yamashita | 355/3 DD |

FOREIGN PATENT DOCUMENTS

| | | | |
|---|---|---|---|
| 0216167 | 12/1984 | Japan | 355/3 DD |
| 0168173 | 8/1985 | Japan | 355/3 DD |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A developing device in which toner fed from a toner cartridge is caused to flow down by a toner supply roller and, then, mixed with a developer by an agitating roller unit which is made up of a spiral blade and a plurality of radial blades. The spiral blade of the roller unit is greater in outside diameter than the radial blades. Those parts of the spiral blade where the individual chambers are located are notched at one side of the spiral blade and intermittently with respect to an order in the circumferential direction, and those parts of the radial blades where the individual chambers into which the developer from the notched parts of the spiral blade flows are notched. The developing device further comprises a developing roller, a paddle wheel for supplying the developer to the developing roller, a doctor blade for regulating the developer on the developing roller to a predetermined thickness, a separator for returning the developer scraped off by the doctor blade toward the paddle wheel and roller unit, a restricting member extending from a developer outlet side of the separator to a position between the paddle wheel and the developer agitating roller unit for blocking a part of the developer collected from the separator. The developer is moved away from the paddle wheel in response to rotation of the roller unit.

8 Claims, 5 Drawing Sheets

AGITATING ROLLER AND RESTRICTING MEMBER FOR A DEVELOPING DEVICE

FIELD OF THE INVENTION

The present invention relates to a developing device for an image-forming apparatus such as a copier.

BACKGROUND OF THE INVENTION

Developing devices heretofore proposed for the above application include one in which toner supplied from a toner cartridge is caused to flow down by a toner supply roller and, then, mixed with a developer by an agitating roller. In this type of developing device, if developer collected from a developing roller is fed toward the agitating roller without any restriction, the developer is caused to sequentially accumulate in a wedge-shaped space which is defined between the agitating roller and the wall of a casing of the device. Then, the accumulated developer blocks toner being transported by the toner supply roller, resulting in the toner being apt to be collected to form a mass without being dispersed in the developer. Should such a mass of toner be bodily mixed with the developer at one time due to vibrations, shocks ascribable to the start and stop of a drive source for driving the developing device, or other causes, it would smear the background of a copy or be scattered out of the developing device to contaminate the interior of the image-forming apparatus.

The agitating roller is usually made up of a spiral blade which extends spirally along the axis of the roller and a plurality of radial blades, each extending radially from the axis of the roller. The spiral and radial blades cooperate to define some chambers for transporting the developer. When the roller having such a configuration is rotated to agitate the developer in both the axial and circumferential directions, it often occurs that the developer entering some of the chambers forms a film on the outer peripheral surface of the roller as time elapses. As a result, the developer becomes packed fast in the chambers. Especially, such a phenomenon is quite liable to occur when the viscosity of the developer is high. Packing of the developer in the chambers as mentioned deteriorates the agitating ability of the agitating roller and invites low density, irregular density, and other problems in reproduction.

OBJECTS OF THE INVENTION

It is, therefore, an object of the present invention to provide a developing device for an image-forming apparatus which promotes smooth dispersion of toner into a developer by eliminating a space in which the developer is apt to accumulate, thereby preventing the background of a copy from being smeared and precluding scattering of toner out of the developing device.

It is another object of the present invention to provide a developing device for an image-forming apparatus which frees a reproduction from low density, irregular density, and other developing problems by preventing the developer from becoming packed in an agitating roller.

It is another object of the present invention to provide a generally improved developing device for an image-forming apparatus.

SUMMARY OF THE INVENTION

In accordance with the present invention, in a developer agitating unit installed in a developing device of an image-forming apparatus and composed of a spiral blade extending spirally along an axis of rotation of the unit, a plurality of radial blades each extending radially to the axis of rotation, and a plurality of chambers defined by the spiral blade and radial blades one after another in a circumferential direction of the unit, the spiral blade is provided with a greater outside diameter than the radial blades. Those parts of the spiral blade where the individual chambers are located are notched only at one side of the spiral blade and intermittently with respect to an order in the circumferential direction. Those parts of the radial blades where the individual chambers into which the developer from the notched parts of the spiral blade flows are notched.

The above and other objects, features, and advantages of the present invention will become more apparent from the following detailed description taken with the accompanying drawings.

DESCRIPTION OF THE PREFERRED EMBODIMENTS

Figure 1:
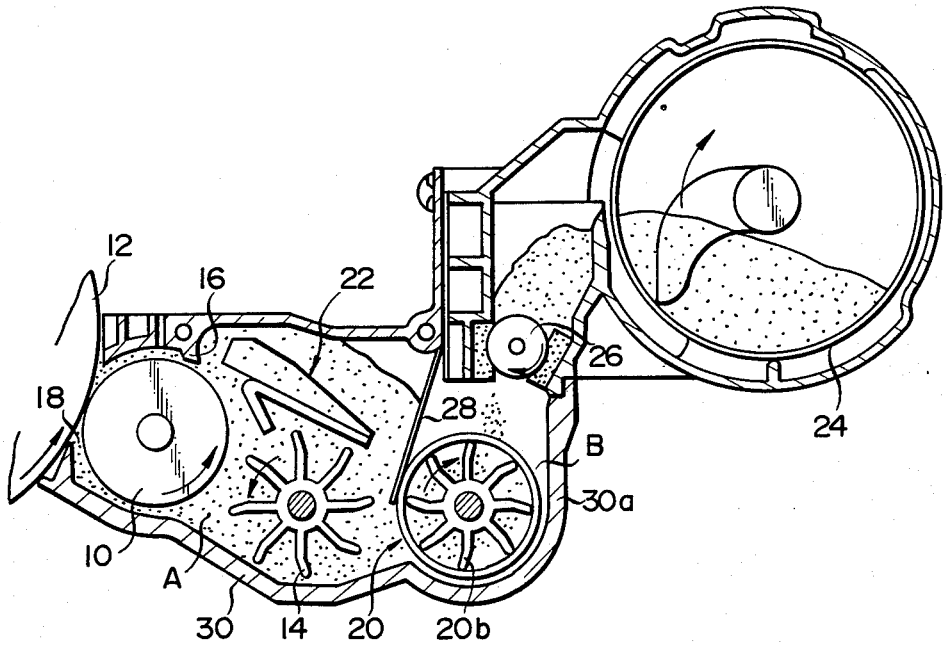
FIG. 1 is a sectional side elevation of a developing device embodying the present invention.

Referring to FIG. 1 of the drawings, a developing apparatus embodying the present invention is shown and includes a developing roller 10. The developing roller 10 has magnets, not shown, which are fixed in place thereinside, so that it may develop an electrostatic latent image in contact with or in close proximity to a photoconductive element 12. Specifially, during development, the developing roller 10 is rotated in a direction indicated by an arrow in the figure and, at a position where it faces a paddle wheel 14, the developing roller 10 is supplied with developer from the paddle wheel 14. The developer deposited on the developing roller 10 is scraped by a doctor blade 16 to be thereby regulated to a predetermined thickness, the resulting developer layer developing an electrostatic latent image which is provided on the photoconductive element 12. After the development, the developer on the developing roller 10 is released from the developing roller 10 as it moves past the lower portion of the developing roller 10. Rotating as indicated by an arrow in the figure, the paddle wheel 14 scrapes the developer being released from the developing roller 10, which tends to remain in a position A, whereby a space for accommodating the developer is defined (should such a function of the paddle wheel 14 be insufficient, the developer might overflow through an opening 18). The paddle wheel 14 transports the developer toward an agitating roller 20 which is located on the opposite side to the developing roller 10 with respect to the paddle wheel 14. The developer transported by the paddle wheel 14 as stated is replaced and mixed with the developer which is supplied from the agitating roller 20 and, further, mixed with the developer which flows down through a separator 22. The resulting mixture is returned toward the developing roller 10. The separator 22 serves to collect the developer which has been scraped off by the doctor blade 16 without advancing past the doctor blade 16, thereby returning it to the paddle wheel 14 and to the agitating roller 20. Fed out from a toner cartridge 24, toner is caused to flow down by a toner supply roller 26 toward the agitating roller 20.

Figure 2:
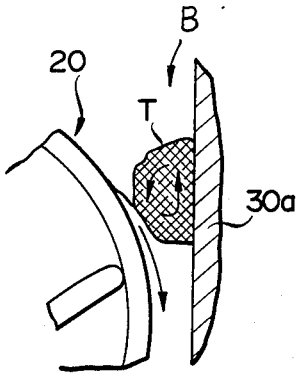
FIG. 2 is a view showing how toner is dispersed in a developer.

The agitating roller 20 functions to mix the developer present thereinside from the beginning, the developer from the paddle wheel 14, and the developer which is caused to flow to an upper portion of the agitating roller 20 by way of opposite sides of a restricting member 28, which will be described. The toner supplied toward the agitating roller 20 as needed is transported by a curtain which is formed of the developer being entrained by the agitating roller 20, whereby the toner is brought into contact with the inner surface of a wall 30*a* adjacent to the agitating roller 20. Specifically, as the peripheral speed of the roller 20 exceeds about 150 millimeters per second, the above-mentioned curtain is formed by the developer on the outer periphery of the agitating roller 20 and moved integrally with the agitating roller 20. Such a phenomenon is observed with the paddle wheel 14 also. As shown in FIG. 2, in a wedge-shaped space B defined between the roller 20 and the wall 30*a*, toner T breaks into particles while rotating relative to the surface of the developer and, therefore, it is introduced in and agitated with the developer.

Figure 3:
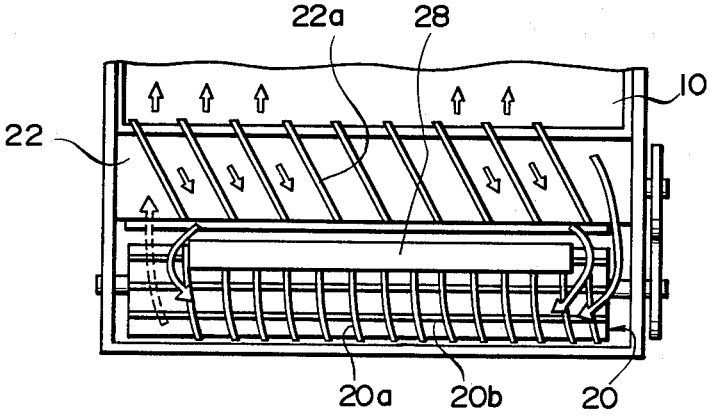
FIG. 3 is a view showing the device of FIG. 1 with an upper portion of its casing removed, specifically showing a relationship between a separator, an agitating roller, and a restricting member.

FIG. 3 is a fragmentary top plan view showing the developing device with an upper portion of a casing 30 removed. As shown, the separator 22 is provided with fins 22*a* which function to cause the developer scraped by the doctor blade 16 to flow down onto the paddle wheel 14 and onto the agitating roller 20 while biasing the developer toward one side (i.e., to the right in the figure). The restricting member 28, previously mentioned, extends from the developer outlet side of the separator 22 to between the paddle wheel 14 and the agitating roller 20. The restricting member 28 blocks most of the developer which is collected by the separator 22, thereby preventing it from reaching the agitating roller 20. Nevertheless, as shown in FIG. 3, a limited part of the developer is admitted through opposite sides of the restricting member 28 as indicated by arrows. That is, not all the developer is prevented from moving by the restricting member 28.

The agitating roller 20 has a spiral blade 20*a* which transports from the right to the left as viewed in the figure: the developer which comes in through opposite ends of the restricting member 28, the developer present on the agitating roller 20 from the beginning, and the developer transported by the paddle wheel 14. At the left end of the agitating roller 20, the spiral blade 20*a* is not provided i.e., only radial blades 22*b* are provided. More specifically, in this particular embodiment, eight radial blades 22*b* are provided. In this particular portion, therefore, the axial transport of the developer by the agitating roller 20 is not performed to allow the developer to accumulate higher than in the other portion and be transported toward the paddle wheel 14.

A first characteristic feature of the present invention is as follows.

Figure 4:
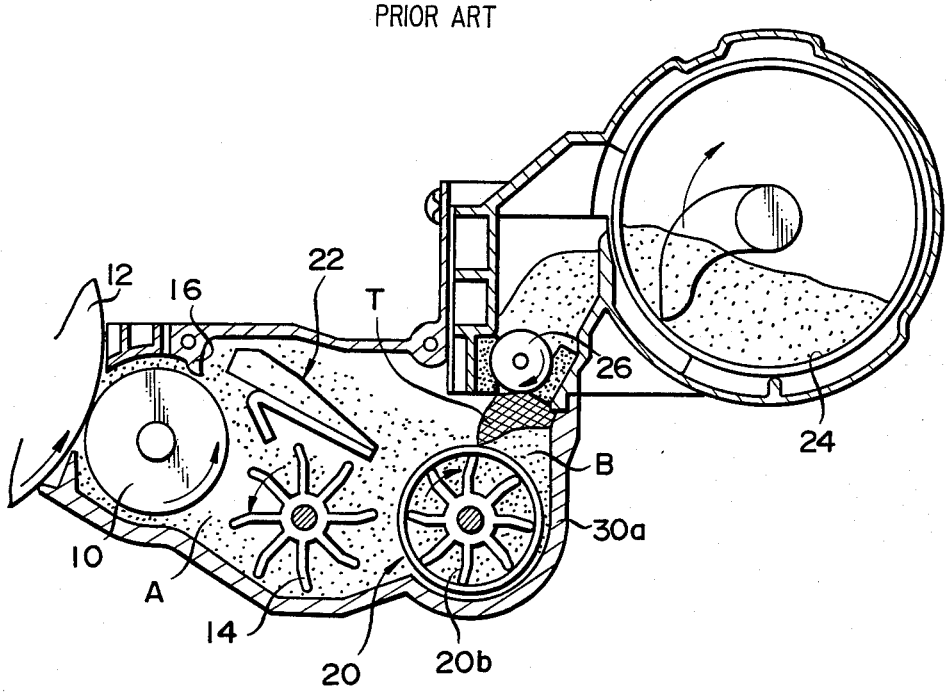
FIG. 4 PRIOR ART
FIG. 4 is a view demonstrating the effect attainable without the restricting member which is installed in the device of FIG. 1.

As shown in FIG. 4, in the case that the developing device lacks the restricting member 28, the developer is moved toward the agitating roller 20 to become collected in the wedge-shaped space B. This collected part of the developer blocks toner which is fed by the toner supply roller 26 and, thereby, prevents it from being readily dispersed in the developer. The resulting mass T of toner is apt to be bodily introduced in the developer at one time for the previously discussed causes, smearing the back of a copy or contaminating the interior of the machine by scattering out of the developing unit.

The restricting member 28 in accordance with the present invention serves to restrict the movement of a part of the developer which is collected from the separator 22, and the developer is caused by the rotation of the agitating roller 20 to move in the same direction as the upper peripheral portion of the agitating roller 20. This prevents the developer from being accumulated in the space B and, therefore, allows the mass of toner T to break into particles while rotating on the agitating roller 20, as shown in FIG. 2. Consequently, the toner is efficiently dispersed in and mixed with the developer to promote highly responsive toner density control. In addition, toner blocking by the developer and, therefore, contamination of a copy and scattering of toner are eliminated.

Hereinafter will be described an agitating roller which constitutes a second characteristic feature of the present invention. The agitating roller in accordance with the present invention is an improved version of the roller 20 which has been described with reference to FIGS. 1 to 4. Hence, the following description will proceed in relation to the agitating roller 20.

Figure 5:
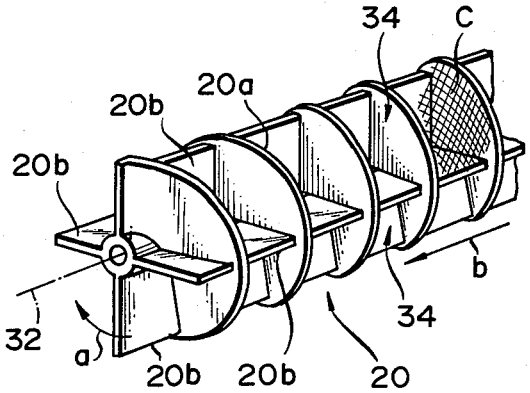
FIG. 5 PRIOR ART
FIG. 5 is a perspective view of the agitating roller as shown in FIG. 1.

First, the construction of the agitating roller 20 shown in FIGS. 1 to 4 will be described in more detail. As shown in FIG. 5, the agitating roller 20 is made up of the spiral blade 20*a*, which extends along the axis 32, and the radial blades 20*b* each extending radially from the axis 32 (four radial blades 20*b* are shown in this example). The spiral blade 20*a* and the four radial blades 20*b* cooperate to define four chambers 34 one after another in the circumferential direction of the agitating roller 20. In the case of the agitating roller 20 shown in FIG. 1, eight such chambers are defined in the circumferential direction because eight radial blades 20*b* are provided on the roller 20. As the roller 20 is rotated as indicated by an arrow a in FIG. 5, the developer scooped up into the chambers 34 are transported as indicated by an arrow b while being scattered toward the paddle wheel 14. In this manner, the agitating roller 20 being rotated agitates the developer and the toner supplied in both the axial and circumferential directions. As stated earlier, while the developer and toner are agitated by the agitating roller 20 in the axial and circumferential directions, the developer admitted into the chambers 34 forms a film, C, at its outer periphery as time elapses. As a result, as shown in FIG. 5, the developer becomes packed in the chamber.

Figure 6:
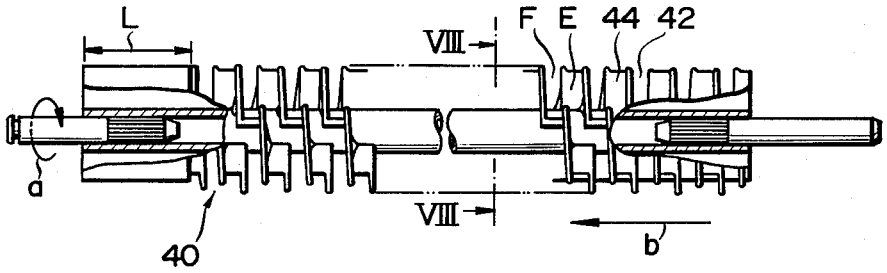
FIG. 6 is a partly sectional side elevation showing a specific structure of the agitating roller in accordance with the present invention.
Figure 7:
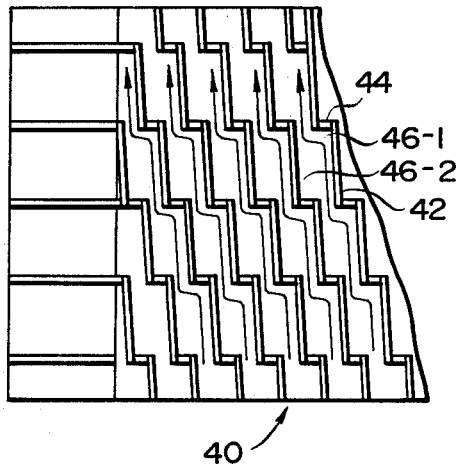
FIG. 7 is a developed view of the roller shown in FIG. 6.
Figure 8:
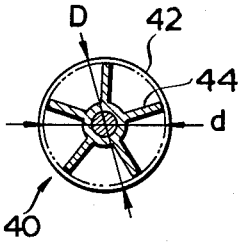
FIG. 8 is a section along line VIII—VIII of FIG. 6.

Referring to FIGS. 6 to 8, a specific structure of an agitating roller of the present invention which is free from the drawback discussed above is shown. As shown in FIG. 6, an agitating roller 40 is located to hold the paddle wheel 14 between the agitating roller 40 and the developing roller 10. The agitating roller 40 comprises a spiral blade 42 and radial blades 44. As shown in FIG. 8, the outside diameter D of the spiral blade 42 is selected to be greater than the outside diameter d of the radial blades 44. Hence, steps are defined between the blades 42 and 44 so that the developer may be moved along the agitating roller 40. Specifically, as regards to a transport chamber 46-1 shown in FIG. 7 by way of example, that part of the spiral blade 42 where the chamber 46-1 is located is notched at one side thereof, as represented by a dash-and-dots line in the figure. Such a notched part is provided intermittently (e.g., alternately in the order of the chambers along the circumferential direction). In FIG. 6, the notched part is represented by a character E. On the other hand, assuming that the developer from the notched part E of the spiral blade 42 flows into a chamber 46-2, the radial blade 44 at which the chamber 46-2 is positioned is notched, as represented by a character F in FIG. 6. The notched part F causes the chamber 46-2 to communicate with the chamber located thereabove as viewed in FIG. 7. Describing it with reference to FIG. 8, the radial blade located next to the radial blade 44 with respect to the counterclockwise direction is notched, the radial blade next to the notched radial blade is not notched, and so on.

The notched parts E and F provided in the blades 42 and 44 as stated above allow the developer to flow through the blades 42 and 44 and, therefore, prevents the developer from packing itself in the chambers. In contrast, the agitating roller 20 shown in FIG. 5 causes the developer to be packed in the chambers 34 because each chamber 34 has a substantially blocked configuration.

In FIG. 6, the agitating roller 40 is void of the spiral blade 42 over an end section L and, instead, provided with the radial blades 44 only. In this configuration, the developer moved to the left is successfully scattered toward the paddle wheel 14 in FIG. 1, to be thereby prevented from accumulating in the end section L.

Figure 9:
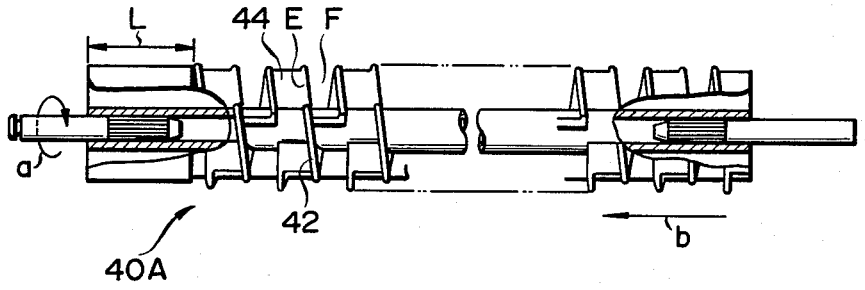
FIG. 9 is a view similar to FIG. 6, showing another specific structure of the agitating roller.
Figure 10:
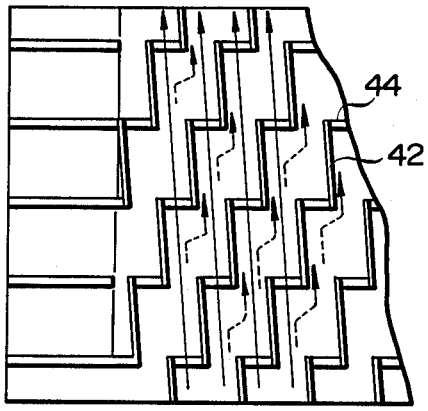
FIG. 10 is a developed view of the roller shown in FIG. 9.

FIG. 9 shows another specific structure of the agitating roller in accordance with the present invention. As shown, the agitating roller 40A is provided with notched parts in different positions from the agitating roller 40 of FIG. 6. Specifically, in the roller 40A, the spiral blade 42 is notched at parts E while the radial blades 44 are notched at parts F. In such a structure, as shown in FIG. 10, the developer is allowed to flow as indicated by solid arrows and, at the same time, biased as indicated by phantom arrows. In this example, a force acts in the returning direction on the developer which is being transported in the direction b, FIG. 9, further enhancing efficient charging of the developer.

In summary, it will be seen that the present invention promotes smooth dispersion of a supplementary part of toner in a developer to thereby eliminate contamination of the background of a copy and scattering of the toner out of the developing device. Since the developer is prevented from packing itself in an agitating roller, it can be desirably agitated to free a reproduction from low density, irregular density, and other adverse occurrences.

Various modifications will become possible for those skilled in the art after receiving the teachings of the present disclosure without departing from the scope thereof.

What is claimed is:

1. In a developer agitating unit installed in a developing device of an image-forming apparatus and composed of a spiral blade extending spirally around an axis of rotation of said developer agitating unit, a plurality of radial blades each extending radially from the axis of rotation, and a plurality of chambers defined by said spiral blade and said plurality of radial blades one after another in a circumferential direction of said developer agitating unit, the improvements wherein:

(a) said spiral blade is provided with a greater outside diameter than the outside diameter of said plurality of radial blades;

(b) those parts of said spiral blade where said plurality of chambers are located are notched at one side of said spiral blade and intermittently with respect to an order in the circumferential direction; and (c) those parts of said plurality of radial blades where said plurality of chambers into which the developer from the notched parts of said spiral blade flows are notched.

2. A developing apparatus comprising:

(a) a photoconductive element;

(b) a developing roller for transporting developer deposited thereon to develop a latent image in contact with or in close proximity to said photoconductive element;

(c) a paddle wheel located adjacent to said developing roller for supplying the developer to said developing roller;

(d) a developer agitating roller unit rotatable in a direction for moving the upper peripheral portion of said roller unit away from said paddle wheel;

(e) a doctor blade for scraping the developer off said developing roller to regulate the developer to a predetermined thickness; and (f) a separator for returning the developer scraped off said developing roller by said doctor blade toward said paddle wheel and towards said developer agitating roller unit, (g) said developer agitating roller unit comprising a spiral blade extending spirally along an axis of rotation of said developer agitating roller unit, a plurality of radial blades each extending radially from the axis of rotation, and a plurality of chambers defined by said spiral blade and said plurality of radial blades one after another in a circumferential direction of said developer agitating rolling unit;

(h) said spiral blade being provided with a greater outside diameter than the outside diameter of said plurality of radial blades;

(i) those parts of said spiral blade where said plurality of chambers are located being notched at one side of said spiral blade and intermittently with respect to an order in the circumferential direction; and (j) those parts of said plurality of radial blades where said plurality of chambers into which the developer from the notched parts of said spiral blade flows being notched.

3. A developing device as claimed in claim 2, and further comprising a restricting member extending from a developer outlet side of said separator to a position between said paddle wheel and said developer agitating roller unit for blocking a part of the developer collected from said separator and the developer being moved away from said paddle wheel in response to rotation of said developer agitating roller unit.

4. A developing apparatus for supplying a developer to a photoconductive element to develop an electrostatic latent image which is provided on said element, said developing apparatus comprising:

(a) a developing roller for transporting the developer deposited thereon to develop the latent image in contact with or in close proximity to the photoconductive element;

(b) a paddle wheel located adjacent to said developing roller for supplying the developer to said developing roller;

(c) a developer agitating roller unit rotatable in a direction for moving the upper peripheral portion of said developer agitating roller unit away from said paddle wheel;

(d) a doctor blade for scraping the developer off said developing roller to regulate said developer to a predetermined thickness;

(e) a separator for returning the developer scraped by said doctor blade toward said paddle wheel and said developer agitating roller unit; and (f) a restricting member extending from a developer outlet side of said separator to a position between said paddle wheel and said developer agitating roller unit for blocking a part of the developer collected from said separator and the developer being moved away from said paddle wheel in response to rotation of said developer agitating roller unit.

5. A developing device as claimed in claim 4, wherein said developer agitating roller unit comprises:

(a) a spiral blade extending spirally along an axis of rotation of said developer agitating roller unit;

(b) a plurality of radial blades each extending radially from said axis of rotation; and (c) a plurality of chambers defined by said spiral blade and said radial blades one after another in a circumferential direction of said developer agitating roller unit, wherein:

(d) said spiral blade is provided with a greater outside diameter than said radial blades;

(e) those parts of said spiral blade where said individual chambers are located are notched only at one side of said spiral blade and intermittently with respect to an order in said circumferential direction; and (f) those parts of said radial blades where said individual chambers into which the developer from said notched parts of said spiral blade flows are notched.

6. A developer agitating unit as recited in claim 1 wherein those parts of said spiral blade where said plurality of chambers are located are notched at one side of said spiral blade and alternately in the order of the chambers along the circumferential direction.

7. A developing apparatus as recited in claim 2 wherein those parts of said spiral blades where said plurality of chambers are located are notched at one side of said spiral blade and alternately in the order of the chambers along the circumferential direction.

8. A developing device as recited in claim 5 wherein those parts of said spiral blades where said individual chambers are located are notched only at one side of said spiral blade and alternately in the order of the chambers along said circumferential direction.

* * * * *